US006896588B2

(12) United States Patent
Lanier et al.

(10) Patent No.: US 6,896,588 B2
(45) Date of Patent: May 24, 2005

(54) CHEMICAL MECHANICAL POLISHING OPTICAL ENDPOINT DETECTION

(75) Inventors: Barry Lanier, Allen, TX (US); Brian E. Zinn, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/678,784

(22) Filed: Oct. 3, 2003

(65) Prior Publication Data

US 2005/0075055 A1 Apr. 7, 2005

(51) Int. Cl.[7] ..... B24B 1/00

(52) U.S. Cl. ..... 451/9; 451/10; 451/11; 451/41; 451/54; 456/345.16; 456/345.13

(58) Field of Search ..... 451/6, 8, 9, 10, 451/11, 41, 54, 59, 63, 285, 287, 288; 156/345.16, 345.13

(56) References Cited

U.S. PATENT DOCUMENTS 5,722,875 A * 3/1998 Iwashita et al. ..... 451/8
6,271,047 B1 * 8/2001 Ushio et al. ..... 438/14
6,628,410 B2 * 9/2003 Doan ..... 356/630
6,670,200 B2 * 12/2003 Ushio et al. ..... 438/14
6,679,756 B2 * 1/2004 Ishikawa et al. ..... 451/6

* cited by examiner

*Primary Examiner*—Eileen P. Morgan
(74) *Attorney, Agent, or Firm*—Peter K. McLarty; W. James Brady, III; Frederick J. Telecky Jr.

(57) ABSTRACT

Light is incident on a semiconductor wafer polish surface and an adjacent reference surface (80). The reflected light from each surface is detected by a detector (35) positioned beneath the surfaces. The signals derived from each source of reflected light is analyzed in a electronic system (37) and an endpoint for a chemical mechanical polish process is determined as a function of both signals.

7 Claims, 3 Drawing Sheets

CHEMICAL MECHANICAL POLISHING OPTICAL ENDPOINT DETECTION

FIELD OF THE INVENTION

The invention is generally related to the field of integrated circuit manufacturing and specifically to an improved method to detect the endpoint of a copper chemical mechanical polishing process.

BACKGROUND OF THE INVENTION

High speed integrated circuits use copper to form the metal lines that connect the various electronic devices that comprise the circuit. Copper lines are formed using a damascene process that is illustrated in FIGS. 4–5(*a*) and FIGS. 4–5(*b*). As shown in FIGS. 4–5(*a*), a dielectric layer 310 is formed over a semiconductor 300. The semiconductor will contain electronic devices such as transistors that are omitted from the Figure for clarity. In a typical simply damascene process, a trench 315 is first formed in the dielectric layer 310. A barrier layer 320 is then formed over the surface of the dielectric layer and in the trench. Typical materials used to form the barrier layer include titanium nitride and other similar materials. Following the formation of the barrier layer 320, a copper a layer 330 is formed. The copper layer is typically formed using a plating process and in addition to filling the trench 315, forms excess copper over the entire semiconductor surface. The excess copper is removed using chemical mechanical polishing (herein after CMP) resulting in the structure shown in FIGS. 4 5(*b*). The remaining copper line 315 is then used to interconnect various electronic devices that are formed in the semiconductor.

During the CMP process a wafer is placed facedown on a rotating wafer holder. A slurry material is placed on a rotating polishing pad and surface of the wafer is brought in contact with the polishing pad thereby removing the targeted material from the surface of the wafer. A critical component of any CMP process is the endpoint detection. In the case of copper if the polishing process is stopped too soon then copper will remain on the surface rendering the circuit inoperable. If the polishing process continues beyond the optimum endpoint then dishing of the copper surface or erosion of the dielectric will occur leading to the presence of defects in the completed circuit or high sheet resistance of the metal. It is therefore crucial that an accurate measure exist to detect the desired endpoint of any CMP process. For many CMP processes the endpoint occurs during the transition from a first material to a second material. This is illustrated in FIG. 4(*b*) where the transition from copper 330 to the underlying barrier layer 320 will signal the removal of all the excess copper from the surface of the wafer.

In one common CMP tool configuration, an optical endpoint detection system is used whereby light of one or more wavelengths is reflected off the polish surface of the wafer during the polish process and then collected by a detector. The change in the reflected light is detected as a signal and is based on the change in the reflective properties of the polished surface as it polishes (i.e. the transition from a metal reflective surface to a barrier layer surface). The signal is compared to a standard or baseline determined for some sample of material processes in this fashion (i.e., experiments are run on a set of wafers to determine the average endpoint characteristics of the "typical" wafer endpoint signal to collected signal of the next wafer to process.) The problem with this approach lies in the comparison of the current endpoint signal to the baseline signal. During the CMP process, variation from a number of sources causes the collected signal to be quite different from the expected signal, resulting in early, late, or an altogether missed endpoint, any of which can have a marked impact on the device structure, electrical performance and long term reliability. In addition the reference point for the endpoint signal detection is set within the set of data collected from the wafer as it is processed. Therefore, on a wafer-to-wafer basis, the reference point for the endpoint signal is not a constant and introduces additional variability into the process.

There is therefore a need for an endpoint detection method that reduces the variability of existing methods. The instant invention addresses this need.

SUMMARY OF THE INVENTION

A semiconductor wafer with a polish surface is affixed adjacent to a reference surface. Light is incident on both the polish surface and the reference surface during chemical mechanical polishing of the polish surface. The light reflected from the polish surface and the reference surface is detected and corresponding signals $S_{tx}$ and $S_B$ are derived for the reflected light from the polish surface and the reference surface respectively. The signals are fed to an electronic system and an endpoint for the chemical mechanical polishing process is determined as a function $f(S_{tx},S_B)$ of both signals. In an embodiment of the instant invention the function is a difference function of both signals.

Figure 1:
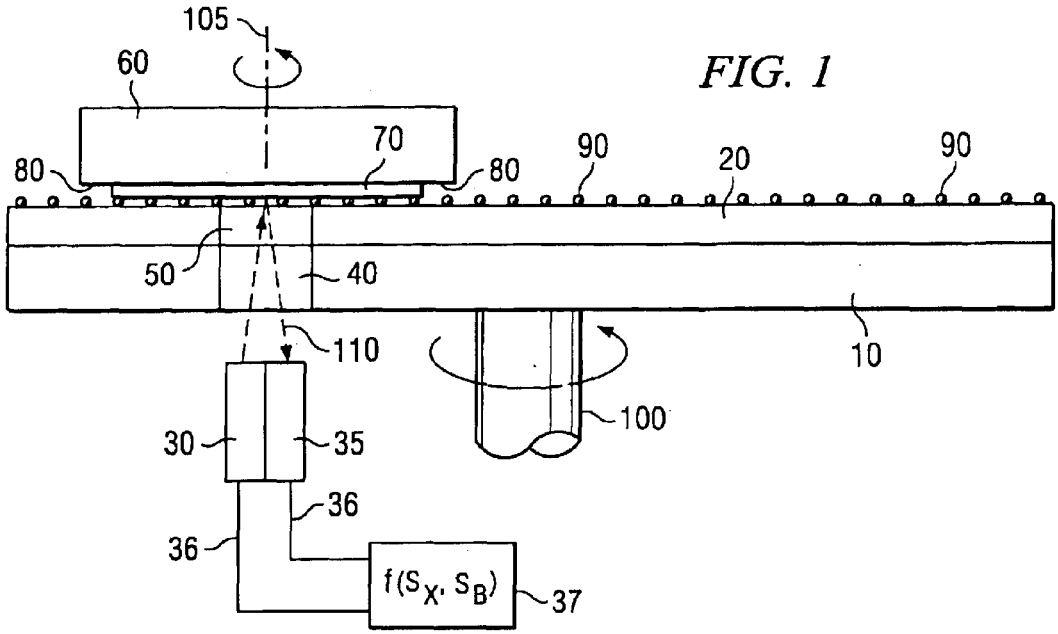
FIG. 1 is a diagram of a CMP tool and wafer according to an embodiment of the instant invention.

Common reference numerals are used throughout the figures to represent like or similar features. The figures are not drawn to scale and are merely provided for illustrative purposes.

DETAILED DESCRIPTION OF THE INVENTION

While the following description of the instant invention revolves around FIG. 1 to FIG. 4, the instant invention can be utilized in many different types of integrated circuit processing. The methodology of the instant invention provides a solution for significant improvement in the detection of the endpoint of a CMP process for the removal of excess metallic material.

Shown in FIG. 1 is a CMP tool configuration according to an embodiment of the instant invention. The CMP tool comprises a wafer holder or carrier 60 on which the wafer 70 is loaded facedown. A polishing pad 20 is mounted on a platform 10 that rotates in a clockwise or counterclockwise direction about the axis of the spindle 100. The wafer holder 60 also rotates about an axis 105 in a clockwise or counterclockwise direction. Fluids 90 comprising polishing slurries, de-ionized water, etc., are introduced onto the surface of the polishing pad 20 to aid in the polishing of the surface of the wafer 70. During the polishing process the surface of the wafer 70 is brought in contact with the surface of the polishing pad 20 and the fluids 90 on the surface of the polishing pad 20. The friction created by the rotating action of the polishing pad 20 and the wafer holder or carrier 60 enables the polishing of the wafer surface. The endpoint of the polishing process is determined by exposing the surface of the wafer to light 110 from a source 30 affixed beneath the polishing pad 20. The term light in this disclosure refers to any stream of photons and includes, but is not limited to, lasers, monochromatic light, white light, etc. The light typically travels through optical windows 40 and 50 positioned in the platform 10 and the polishing pad 20 respectively. The reflected light 110 is detected by a detector 35 positioned beneath the platform 10 and analyzed by an electronic system 37 that is connected 36 to the detector 35 and the light source 30 to determine the endpoint of the CMP process. In an embodiment of the instant invention the detected signal from the surface of the wafer is compared to a reference or baseline signal caused by light reflected from a reference surface different from the surface of the wafer. In the embodiment shown in FIG. 1 the reference signal comes from the light that is reflected from the reference surface 80 adjacent to the wafer 70. The derivation of the reference signal and the corresponding endpoint analysis according to an embodiment of the instant invention is shown in FIG. 2, FIG. 3, and FIG. 4.

Figure 2:
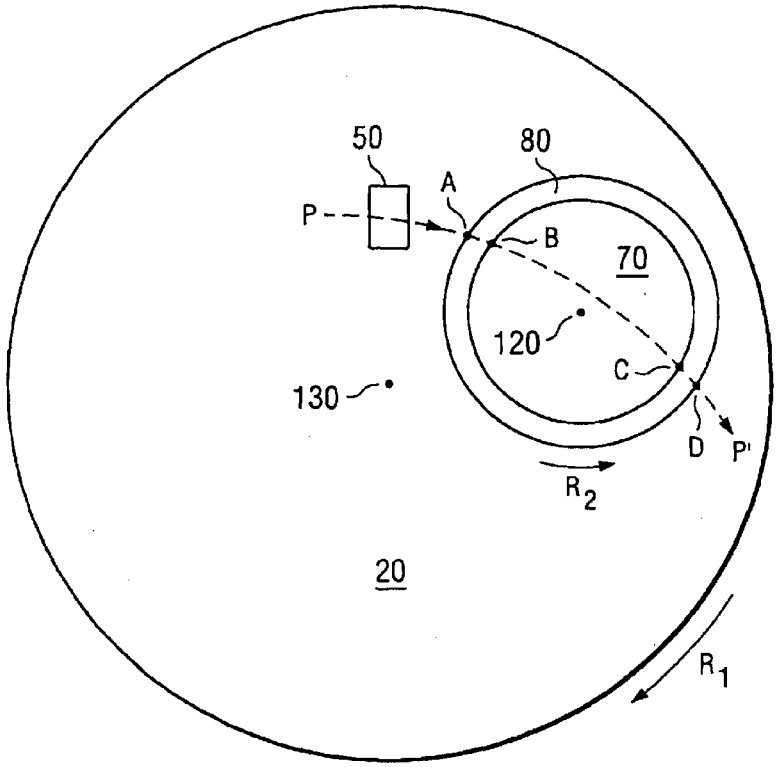
FIG. 2 is a plan view of a section of a CMP tool and wafer according to an embodiment of the instant invention.

Shown in FIG. 2 is a plan view of a polishing pad 20, a wafer 70, and a reference surface 80 according to an embodiment of the instant invention. As described above, in a first embodiment the polishing pad 20 rotates about an axis 130 in a direction $R_1$ shown in FIG. 2. As the polishing pad rotates, the wafer 70 and the reference surface 80 also rotate about the axis 120 in the direction $R_2$ shown in the Figure. At some time during the rotation of the polishing pad 20, the optical window 50, through which the incident and reflected light passes, will be beneath the surface of the wafer 70 or the reference surface 80. During this time the detector 35 will detect a signal due to the reflection of the incident light from the surface of the wafer 70 or the reference surface 80. Shown in FIG. 2 is a point A on the outer edge of the reference surface 80. It is intended that A represent any point on the leading outer edge of the reference surface 80. In a similar manner B represents any point on the leading inner edge of the reference surface 80, as well as any point on the leading outer edge of the wafer 70. C represents any point on the lagging inner edge of the reference surface 80 as well as any point on the lagging outer edge of the wafer 70, and D represents any point on the lagging outer edge of the wafer 70. In FIG. 2 the inner edge of the reference surface 80 and the outer edge of the wafer 70 are coincident. However the instant invention is not to be limited to this configuration. Any configuration comprising a reference surface 80 and a wafer 70 is intended to fall within the instant invention.

Figure 3:
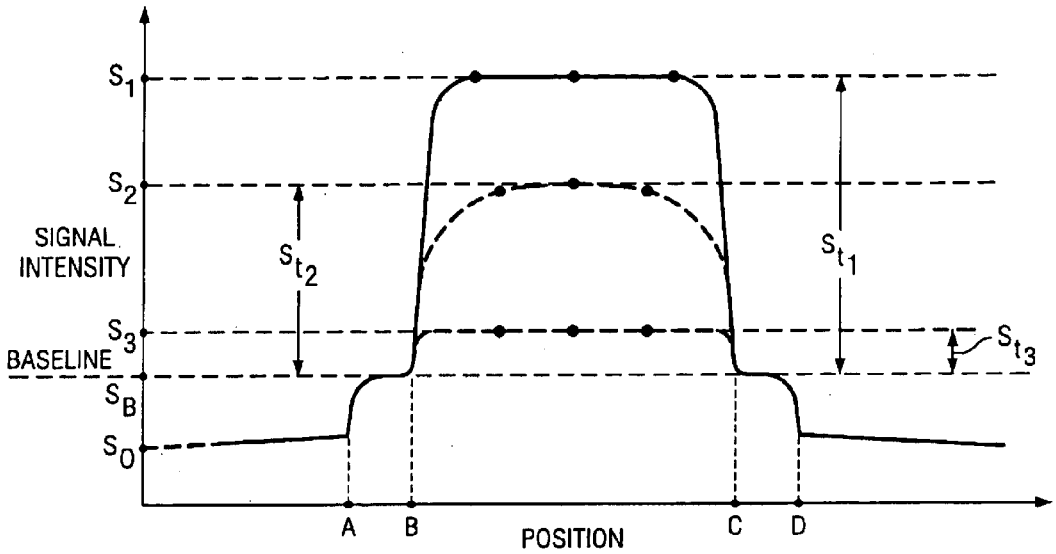
FIG. 3 is a plot of the signal intensity versus wafer position according to an embodiment of the instant invention.
Figure 4:
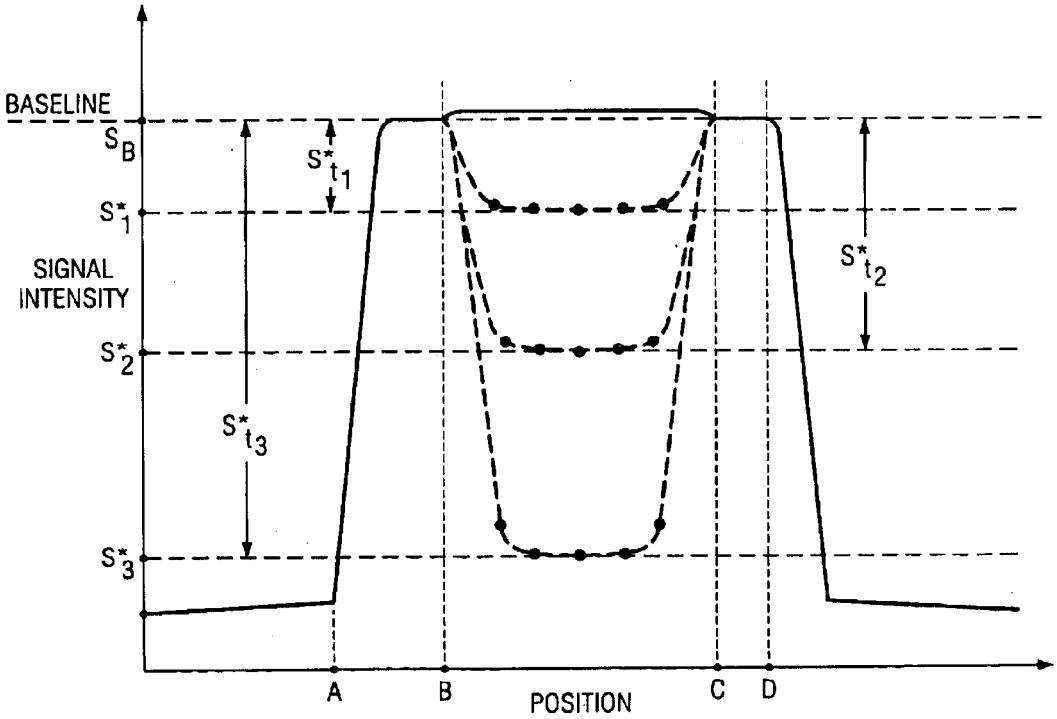
FIG. 4 is a plot of the signal intensity versus wafer position according to a further embodiment of the instant invention.
Figure 5A:
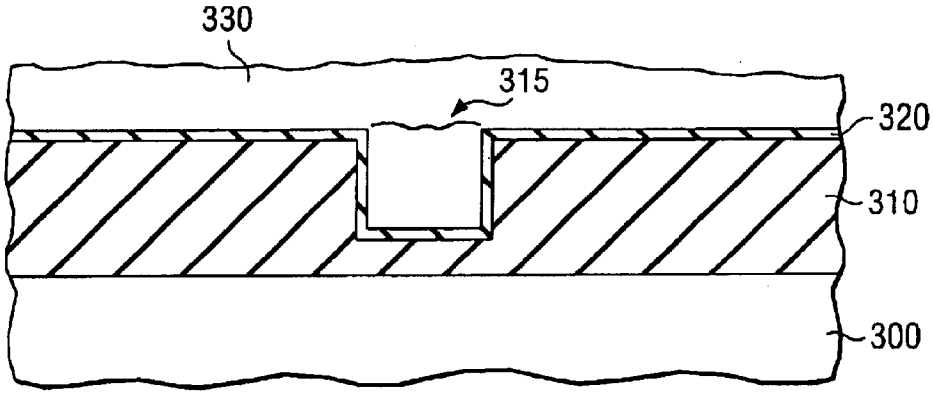
FIG. 5a (PRIOR ART)
FIGS. 5(*a*) and 5(*b*) are steps in a damascene process according to the prior art.
Figure 5B:
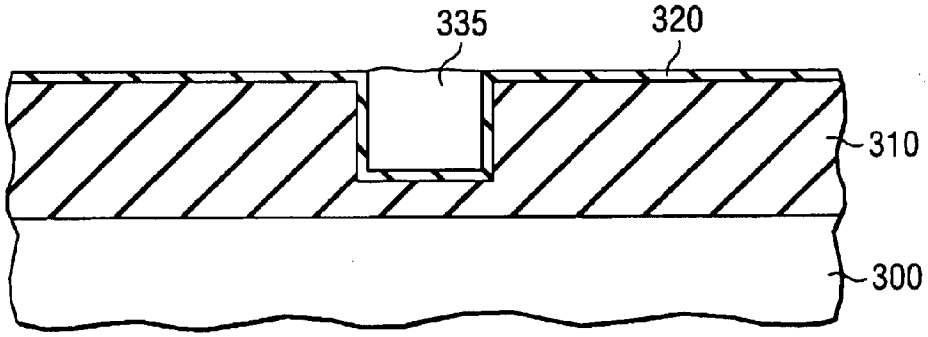
FIG. 5b (PRIOR ART)

Shown in FIG. 3 is an example of a plot of signal intensity obtained as a function of the position of the wafer 70 and reference surface 80 in relation to the optical window 50 (and therefore the incident and reflected light) during the removal of excess copper from the surface of the wafer 70. The signal intensity shown in FIG. 3 is related to the intensity of the reflected light detected by the detector 35 shown in FIG. 1. Due to the relative rotations of the polishing pad 20, the wafer 70, and the reference surface 80, the wafer 70 and the reference surface 80 will pass over the optical window 50 in a line or arc roughly approximated by the position of the points A, B, C, and D and the connecting dashed line PP' shown in FIG. 2. At some arbitrary time $t_0$ the relative positions of the optical window 50, wafer 70, and the reference surface 80 are as shown in FIG. 2. There is no reflected signal and the signal intensity obtained is represented by the signal $S_0$ in FIG. 3. As the leading outer edge A of the reference surface crosses the optical window the light reflected from the reference surface will cause the signal intensity to rapidly rise to the baseline or reference level $S_B$ shown in FIG. 3. As the reference surface passes over the optical window the signal intensity will remain relatively constant at the baseline or reference level $S_B$ as shown in FIG. 3 for signal intensity levels between the position points A and B on the plot. The level of the signal intensity $S_B$ will depend on the reflectivity of the reference surface 80. As the leading edge of the wafer B crosses the optical window 50, the signal intensity will then be determined by the light reflected from the surface of the wafer and will rapidly change to a new value represented by the signal intensity $S_1$ shown in FIG. 3. For the embodiment shown in FIG. 3, the reflectivity of the wafer surface is greater than the reflectivity of the reference surface 80 resulting in the signal intensity obtained from the wafer surface $S_1$ being greater than the signal intensity $S_B$ obtained from the reference surface 80. As the wafer surface passes over the optical window 50, the signal intensity will remain relatively constant at the level $S_1$ as shown in FIG. 3 for signal intensity levels between the position points B and C on the plot. As the optical window 50 transitions from the lagging edge of the wafer to the lagging edge of the reference surface (i.e., point C) the signal intensity will again fall to $S_B$, the value obtained from the reference surface 80. This is indicated at position point C in FIG. 3. As the optical window passes between the lagging inner edge C and the lagging outer edge D of the reference surface 80, the signal intensity will remain approximately constant at $S_B$ as shown in FIG. 3. Finally at the point where the optical window crosses the lagging outer edge D of the reference surface 80, the signal intensity will fall to the background level $S_0$ as shown in FIG. 3. From the signal intensity plot shown in FIG. 3, a derived signal $S_{t1}$ can be obtained from the difference between the signal $S_1$ and $S_B$ at a time $t_l$.

At a time $t_2>t_1$ the thickness of the excess copper remaining on the surface of the wafer 70 is assumed to have been reduced by polishing such that the reflectivity of the wafer surface is reduced. This reduction in the reflectivity of the wafer surface, as the excess copper is removed, results in a reduction in the signal intensity obtained when the optical window passes between points B and C in FIG. 2. The signal intensity obtained at time $t_2$ is shown in FIG. 3 as $S_2$. A derived signal $S_{t2}$ can be obtained from the difference between the signal $S_2$ and $S_B$ at a time $t_2$. Due to the reduction in the reflectivity of the wafer surface as the copper is removed the derived signal $S_{t2}$ will be less than $S_{t1}$. At a time $t_3>t_2>t_1$ it is assumed that the copper is mostly removed from the wafer surface and the reflectivity of the wafer surface is reduced even further as indicated by the signal intensity level $S_3$ obtained from the wafer surface at this time. A corresponding signal $S_{t3}$ can be derived from the difference between the signals $S_3$ and $S_B$ at time $t_3$. In general, the endpoint of the CMP copper removal process is determined when a predetermined difference signal $S_{tx}$ is measured. Here $t_x$ represents a time after the commencement of the CMP copper removal polish process. Therefore, for the specific embodiment shown in FIG. 3, if it had been determined previously that the excess copper is removed when a derived signal $S_{t3}$ is obtained, then at the time $t_3$ the CMP process would endpoint and be stopped. The derived signal obtained at the endpoint of a particular process is determined by first characterizing the process. Such characterization will include but not be limited to the reflectivity of the reference surface 80, the reflectivity of the wafer surface covered with excess copper, and the reflectivity of the wafer surface with the excess copper removed. In determining the various signal levels $S_0$, $S_B$, $S_1$, $S_2$, etc. a number of different approaches can be taken. In a first approach the various signals could represent the maximum signal obtained with the optical window in a certain position. For example, with the optical window positioned between B and C, the signal $S_1$ represents the maximum or peak intensity signal value measured between position points B and C in FIG. 3. In other approaches some kind of averaging of the signal intensity between position points could be used to determine the various signal levels. Using the same example as above, with the optical window positioned between B and C, in this case the signal $S_1$ represents the averaged intensity signal value measured between position points B and C in FIG. 3. This signal average can be obtained using any known averaging technique.

In further embodiments of the instant invention, the derived signals $S_{t1}$, $S_{t2}$, $S_{t3}$, etc. need not be limited to the difference of the measured signals. In other embodiments of the instant invention the derived signals can be obtained as a function of the pairs of signals $S_1$ and $S_B$, $S_2$ and $S_B$, $S_3$ and $S_B$, etc. In mathematical notation this relationship can be represented in a general way as $$S_{tx}=f(S_x,S_B),$$

where $S_x$ is the intensity signal measured at a time $t_x$ where x=1, 2, 3, etc., and $S_B$ is the baseline or reference intensity signal. The function includes, but is not limited to, averages, weighted averages, etc.

In the embodiment shown in FIG. 3 the reflectivity of the reference surface was less than the reflectivity of the wafer surface covered with excess copper. In other embodiment this might not be the case and in some instances it might be advantageous to have the reflectivity of the reference surface exceed that of the wafer surface. An example of the intensity obtained in such a case is shown in FIG. 4. As shown in FIG. 4, the baseline or reference signal intensity $S_B$ is greater than the signal intensities $S^*_1$, $S^*_2$, $S^*_3$, etc. obtained as the excess metal is removed from the surface of the wafer during the CMP process. As described above, the derived signals can be obtained as a function of the pairs of signals $S^*_1$ and $S^*_B$, $S^*_2$ and $S^*_B$, $S^*_3$ and $S^*_B$, etc. In mathematical notation this relationship can be represented in a general way as $$S^*_{tx}=f(S^*_x,S_B),$$

where $S^*_x$ is the intensity signal measured at a time $t_x$ where x=1, 2, 3, etc., and $S_B$ is the baseline or reference intensity signal. In the most general case then it can be said that the endpoint of the CMP copper removal process is determined when a predetermined derived signal $s_{tx}=f(S_x,S_B)$ is obtained.

The method of the instant invention determines the endpoint of a CMP process when a predetermined derived signal $S_{tx}=f(S_x,S_B)$ is obtained. This should be compared with the prior art where no baseline signal is obtained from a reference surface. In the prior art the baseline is determined by measuring a number of wafers and determining the measured signal obtained when all the excess copper is removed. In the case of the instant invention a baseline signal is determined from a reference surface for each wafer polished. As described above, the properties of the optical window 50 will change over time as more and more wafers are polished. This change will severely limit the accuracy of the prior art method in determining the polish endpoint over the life of the pad. The instant invention overcomes the shortcomings of the prior art method by measuring the baseline signal from a reference surface 80 for each wafer polished. As the optical properties of the window 50 change over the life of the pad, both the baseline signal and the signal obtained from the wafer surface will be equally affected. The derived signal (which depends on a relationship between these signals) will therefore not be affected by the changing properties of the optical window 50. The endpoint detection method of the instant invention results in a consistent endpoint detection method over the life of the pad.

The method of the instant invention has been described using a copper CMP process. The method of the instant invention is however not limited to this process. The method of the instant invention can be applied to any CMP process where a reference surface is provided and the reflectivity of the wafer surface changes as the wafer surface is polished.

We claim:

1. A method for determining the endpoint of a chemical mechanical polish process, comprising:

providing a semiconductor wafer with a polish surface;

mounting said wafer adjacent a reference surface;

polishing said polish surface using a chemical mechanical polishing process;

sequentially exposing said polish surface and said reference surface to a light source;

at a first time $t_o$, measuring a signal $S_x$ from said polish surface;

at a second time ti following $t_o$, measuring a signal $S_B$ from said reference surface;

deriving a signal $S_{tx}$ given by $S_{tx}=f(S_x, S_B)$; and determining an endpoint of said chemical mechanical polishing process when the derived signal $S_{tx}$ equals a predetermined level.

2. The method of claim 1 wherein said signal $S_x$ is a maximum signal obtained.

3. The method of claim 1 wherein said signal $S_x$ is an average signal obtained between a plurality of position points.

4. The method of claim 1 wherein said derived signal is a difference between $S_x$ and $S_B$.

5. An endpoint method for chemical mechanical polishing, comprising:

providing a semiconductor wafer with a polish surface;

mounting said wafer adjacent a reference surface;

polishing said polish surface using a chemical mechanical polishing process;

sequentially exposing said polish surface and said reference surface to a light source;

at a first time $t_o$, measuring a signal $S_x$ from said polish surface;

at a second time $t_1$ following $t_o$, measuring a signal $S_B$ from said reference surface;

deriving a signal $S_{tx}$ given by $S_{tx}=f(S_x,S_B)$ wherein said derived signal $S_{tx}$ is a difference between $S_x$ and $S_B$; and determining an endpoint of said chemical mechanical polishing process when the derived signal $S_{tx}$ equals a predetermined level.

6. The method of claim 2 wherein said signal $S_x$ is a maximum signal obtained.

7. The method of claim 3 wherein said signal $S_x$ is an average signal obtained between a plurality of position points.

* * * * *